United States Patent [19]

Adin et al.

[11] 4,124,392

[45] Nov. 7, 1978

[54] COBALT COMPLEX AMPLIFICATION IMAGING SYSTEM WITH BLOCKED DYE PRECURSOR

[75] Inventors: Anthony Adin, Rochester; Thomas J. Huttemann, Rushville; Robert D. Lindholm, Rochester, all of N.Y.

[73] Assignee: Eastman Kodak Company, Rochester, N.Y.

[21] Appl. No.: 720,874

[22] Filed: Sep. 7, 1976

[51] Int. Cl.[2] ..... G03C 1/40; G03C 1/52; G03C 1/00; G03C 5/24

[52] U.S. Cl. ..... 96/77; 96/48 R; 96/49; 96/75; 96/88; 96/119 R; 428/411; 428/913; 96/48 HD

[58] Field of Search ..... 96/48 R, 48 HD, 48 PQ, 96/49, 88, 91 R, 91 N, 77, 75, 119 R; 428/411, 913; 252/188.3 R

[56] References Cited

U.S. PATENT DOCUMENTS

| | | | |
|---|---|---|---|
| 2,774,669 | 12/1956 | Marron et al. | 96/49 |
| 3,469,984 | 9/1969 | Bialezak | 96/75 |
| 3,561,969 | 2/1971 | Burg | 96/90 |
| 3,615,565 | 10/1971 | Gerlach et al. | 96/90 |
| 3,862,842 | 1/1975 | Bissonette | 96/55 |
| 3,880,658 | 4/1975 | Lestina et al. | 96/77 |
| 3,887,372 | 6/1975 | Bailey | 96/88 |
| 3,935,263 | 1/1976 | Lestina et al. | 96/29 D |

FOREIGN PATENT DOCUMENTS 975,457 11/1964 United Kingdom.

OTHER PUBLICATIONS

Endicott et al., "Photoreduction of Cobalt (III) Complexes at 2537A", *J. of the Am. Chem. Soc.* 87:15 8/5/1965 p. 3348.

"Imaging element using photoreductants" *Research Disclosure* vol. 126, Publ. No. 12617 10/1974.

*Primary Examiner*—Richard L. Schilling
*Attorney, Agent, or Firm*—Dana Schmidt

[57] ABSTRACT

An imaging system is provided wherein a blocked dye precursor is activated by an amine to an unblocked form which, in the presence of an inert cobalt (III) complex containing amine releasing ligands, undergoes a redox reaction to form a dye. The amine generated during the redox reaction causes further dye formation, giving increased speed.

12 Claims, 11 Drawing Figures

FIG. 1
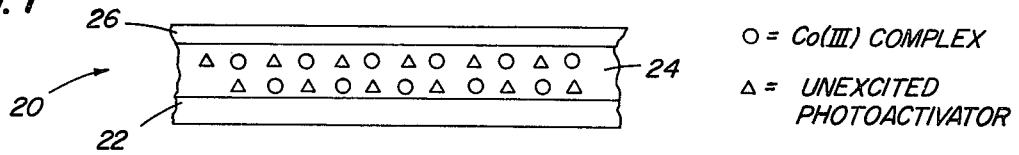
FIG. 2
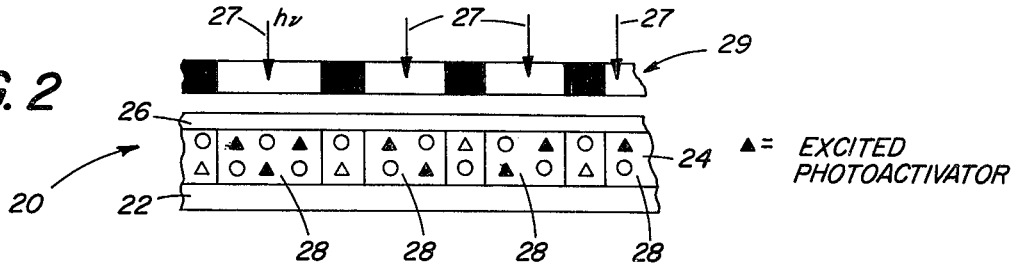
FIG. 3
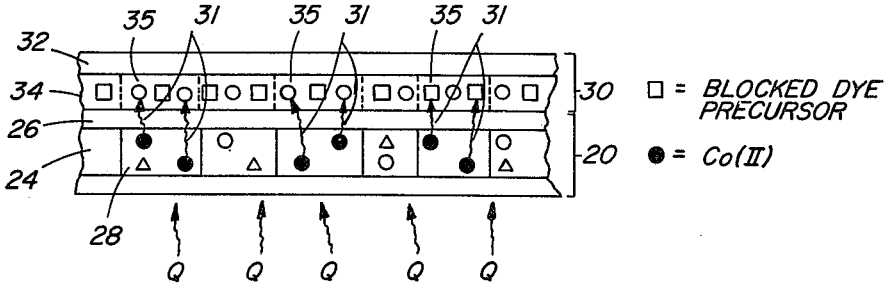
FIG. 4
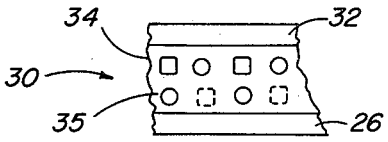
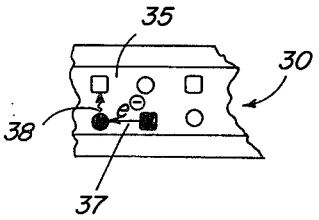
FIG. 5
FIG. 6
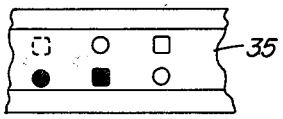
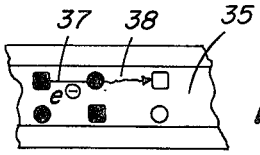
FIG. 7
FIG. 8
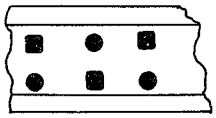
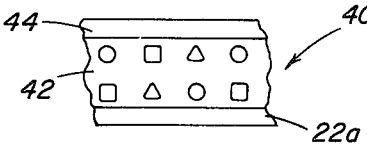
FIG. 10

COBALT COMPLEX AMPLIFICATION IMAGING SYSTEM WITH BLOCKED DYE PRECURSOR

BACKGROUND OF THE INVENTION (1) Field of the Invention

This invention relates to an imaging process and element. The invention relies upon the photoactivated decomposition of a cobalt complex to form products which are especially useful in the initiation of image-wise dye formation. In a preferred form the invention relates particularly to an element having an internal amplification factor.

(2) State of the Prior Art

Non-silver imaging systems of many kinds have been developed in an effort to avoid the increasing cost of silver. However, most of these systems have a speed that is far lower than that achieved by silver. Diazo systems wherein ammonia initiates coupling between a color coupler and unexposed diazonium salt is an example of such a slower, non-silver system.

Another example of a system having a relatively slow speed is one incorporating a salt of a metal ion which is above hydrogen in the electromotive series and, as a photosensitizer, a 9,10-phenanthrenequinone. U.S. Pat. No. 3,561,969 is representative of such a system.

Recently, several non-silver systems based upon the decomposition of cobalt complexes were developed which did have a high gain and therefore increased speed. Commonly owned U.S. application Ser. No. 461,057, entitled "Transition Metal Photoreduction Systems and Processes", filed 15, 1974, by A. Adin and J. C. Fleming, now abandoned in favor of a continuation-in-part application Ser. No. 618,186, filed on Sept. 30, 1975, and now abandoned, discloses phthalaldehyde as a reducing agent precursor. In the last-named application, a leuco dye is added in solution to an already exposed imaging element and undergoes a redox reaction with unexposed inert cobalt (III) complex without requiring the presence of ammonia. The leuco dye, such as leuco malachite green, is not blocked.

An amplification system is disclosed in commonly assigned U.S. application Ser. No. 461,172, filed Apr. 15, 1974, by T. DoMinh, entitled "High Gain Transition Metal Complex Imaging", now abandoned in favor of a continuation-in-part application Ser. No. 627,417, filed on Oct. 30, 1975. The amplification in that case was achieved by incorporating in the element compounds capable of forming at least bidentate chelates with cobalt (II), which act as a catalyst for the reduction of remaining cobalt (III) complexes, thus amplifying the image. However, in such a system care must be taken to exclude acid anions having pKa values high enough to deprotonate the cobalt (II) chelates.

Imaging systems have been developed which rely upon the oxidation of leuco dyes or upon the unblocking of a blocked color coupler or dye to form an image. Representative examples can be found in U.S. Pat. No. 3,615,565, British Pat. No. 975,457 and Research Disclosure, vol. 126, Oct. 1974, Publication No. 12617, Para. III(E)2). These do not however achieve amplification by reason of the oxidation or the unblocking mechanisms.

Oxichromic compounds having a moiety in the form of (COUP)-NH-Ar-X are disclosed in U.S. Pat. Nos. 3,880,658 and 3,935,263, wherein (COUP) is a photographic color-forming coupler and X is a defined moiety, preferably a hydroxyl group. These compounds are not used with cobalt complex chemistry, but rather are directed to silver halide imaging.

Other background references which relate only generally to the field of metallic complexes of amines for imaging include U.S. Pat. Nos. 3,469,984and 2,774,669, and an article by J. Endicott and M. Hoffman in *J. American Chem. Soc.*, Vol. 87, p. 3348, (1965).

OBJECTS OF THE INVENTION

It is an object of the invention to provide a non-silver imaging element capable of internal amplification, in which the amplification is achieved by the unblocking of a dye precursor.

It is a further object of the invention to provide such an element which will produce a chromatic image without the necessity of liquid processing or development.

A related object of the invention is to provide such an element which is compatible with other amplification mechanisms so as to achieve the maximum gain possible.

Other objects and advantages will become apparent upon reference to the following Summary of the Invention and description of the Preferred Embodiments, when read in light of the attached drawings.

SUMMARY OF THE INVENTION

The invention concerns an imaging element and process which produces an amplified color image without wet processing by the use of the redox capability of unblocked dye precursors in combination with cobalt (III) complexes.

More specifically, there is provided an imaging element comprising at least one image-providing layer, the layer including an inert cobalt (III) complex containing amine-releasing ligands, the complex being reducible to a form which releases the ligands, and a blocked dye precursor which is amine activatable to form an unblocked dye precursor capable of an oxidation-reduction reaction with the complex to form a dye.

The image-providing layer can be rendered radiation-sensitive by including within it a photoactivator, or alternatively, a separate radiation-sensitive layer can be positioned adjacent to the image-providing layer, such radiation-sensitive layer including means for releasing amines in response to activating radiation.

BRIEF DESCRIPTION OF THE DRAWINGS

FIG. 1 is a fragmentary, schematic sectional view of a radiation-sensitive element as can be used in accordance with the invention, illustrating its condition prior to exposure;

FIGS. 2–8 are fragmentary, schematic sectional views similar to FIG. 1, but illustrating exposure and subsequent development of the imaging element.

FIG. 10 is a fragmentary, schematic sectional view similar to FIG. 1, but illustrating an alternate embodiment.

DESCRIPTION OF THE PREFERRED EMBODIMENTS

Figure 9:
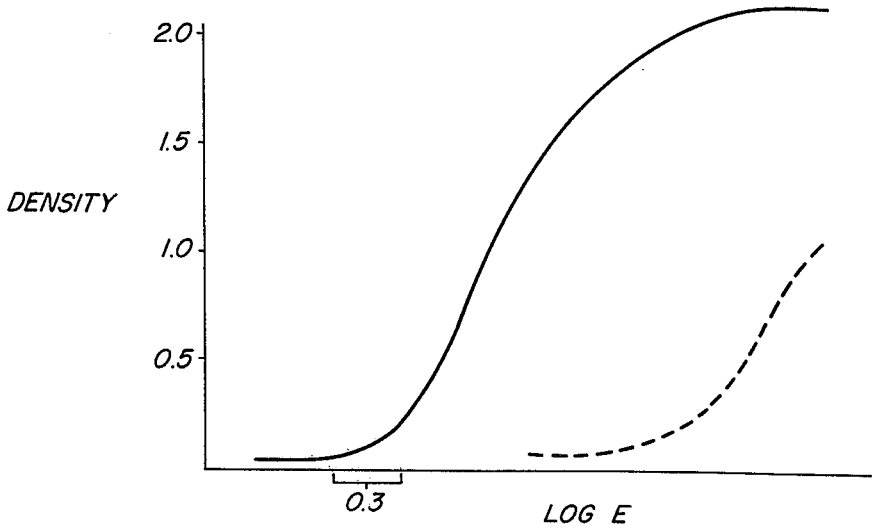
FIG. 9 is a plot of optical density versus log exposure wherein the two sensitometric curves illustrate by comparison an increased speed attained by the invention.

The invention concerns an imaging element having a layer in which a redox reaction is initiated by the imagewise presence of an amine in the layer and amplified by the effect of the amine on a class of dye precursors. Specifically, the layer contains a blocked dye precursor and an inert cobalt (III) complex capable of reaction with the precursor when it is unblocked by an amine such as ammonia. (As used herein, "amine" includes ammonia.) Such amine can be supplied in any convenient manner. For example, a radiation-responsive element containing amine ligands in suitable cobalt (III) complexes can be made to release ammonia imagewise. When an imaging element comprising the aforesaid layer of blocked dye precursor and cobalt (III) complex is juxtaposed with the radiation-sensitive element, the amine such as ammonia is selectively transferred to the imaging element where, because of the unblocking of the precursor caused by the amine the dye precursor undergoes a redox reaction with the cobalt complex. Such redox reaction creates more amine, which in turn causes neighboring blocked dye precursors to be unblocked and oxidized by remaining cobalt (III) complex, so that an amplification of the image and a speed increase are achieved. After development of the image in this fashion, the two elements can be separated.

Alternatively, both elements can be combined into a single element so that the cobalt (III) complex acts both to photo-generate amines in response to an imagewise exposure and to react with the dye precursor when the amine so photo-generated unblocks the precursor.

As used herein, the following terms have the indicated meaning:

"Dye precursor" means any compound capable of being oxidized to a form which is either itself the desired dye or which is capable of combining with another compound in the element, such as a color coupler, without further processing, to form the desired dye. Thus, preferred examples of such dye precursors include leuco dyes which already contain a color coupler as part of the compound and color developing agents. Known color developing agents include primary aromatic amines, such as p-phenylene diamines, p-amino phenols, and sulfonamido anilines. "Blocked dye precursor" means a dye precursor to which a group or radical is attached so as to interfere with the ability of the dye precursor to be oxidized. In the case of coupler-containing dye precursors, such as leuco dyes, the blocking group is preferably a carbonyl which has displaced the hydroxyl hydrogen of a phenol moiety or is attached to a conjugated nitrogen atom which links the coupler to the remainder of the dye. In the case of color developing agents, such as p-phenylene diamines not yet coupled, the blocking mechanism can be by the protonation of one or both of the two amine groups which when deprotonated forms an amine group capable of being oxidized in a redox reaction with the cobalt complex, or by acetylation.

The phrase "redox reaction with the complex to form a dye" means a reaction wherein the dye precursor, when oxidized by the complex, either forms directly a dye, as in the case of leuco dyes, or forms the dye indirectly by a further reaction with a color coupler which is present.

"Inert cobalt (III) complex" means a complex of the cobalt ion with a ligand such as a Lewis base which, when a test sample thereof is dissolved at 0.1 molar concentration at 20° C. in an inert solvent solution also containing 0.1 molar concentration of a tagged ligand of the same species which is uncoordinated, exhibits essentially no exchange of uncoordinated and coordinated ligands for at least 1 minute and preferably for at least several hours such as up to 5 hours or more. This test is advantageously conducted under the pH conditions which will be utilized in the practice of the invention. Many cobalt complexes useful in this invention show essentially no exchange of uncoordinated and coordinated ligands for several days. The definition of "inert" metal complexes and the method of measuring ligand exchange using radioactive isotopes to tag lagands are well-known in the art; see, for example, Taube, *Chem. Rev.*, Vol. 50, page 69 (1952) and Basolo and Pearson, *Mechanisms of Inorganic Reactions, A Study of Metal Complexes and Solutions*, 2nd Edition, 1967, published by John Wiley and Sons, page 141.

The complex preferably contains at least one amine ligand and can contain other ligands such as halides, e.g., chloride, bromide or fluoride, as well as other common ligands such as nitrate, nitrite, water, amino, azide, thiocyanate, isothiocyanate, carbonate, sulfite, sulfate, perchlorate, and acetate groups. Those cobalt complexes having coordination numbers of 6 and known as octahedral complexes are preferred, and within this group the most highly preferred are those in which the majority of the ligands are amines. Also preferred are those having at least 5 ammine ligands. Cobalt hexaammine salts are especially useful in the successful practice of this invention, such as $[Co(NH_3)_6]X$. Other desirable ammine complexes include $[Co(NH_3)_5H_2O]X$, $[Co(NH_3)_5CO_3]X$, $[Co(NH_3)_5Cl]X$ and $[CO(NH_3)_4CO_3[X$, wherein X represents one or more anions determined by the charge neutralization rule.

In one form the complex can be a neutral compound free of anions or cations. If anions are necessary for charge balance, especially useful anions include those such as halides (e.g., chloride, bromide, fluoride, etc.), sulfite, sulfate, alkyl or aryl sulfonates, nitrate, nitrite, perchlorate, carboxylates (e.g., halocarboxylates, acetate, hexanoate, etc.), hexafluorophosphate, and tetrafluoroborate, as well as other similar anions. Exemplary useful examples of complexes include hexa-ammine cobalt (III) acetate, hexa-ammine cobalt (III) thiocyanate, bromopenta-ammine cobalt (III) bromide, aquopenta-ammine cobalt (III) nitrite, trinitrotriammine cobalt (III), tris(1,3-propanediamine) cobalt (III) trifluoroacetate, and $\mu$-superoxodeca-ammine dicobalt (III) perchlorate. A longer list of these and other complexes is published in *Research Disclosure*, Vol. 126, Oct. 1974, publication No. 12617, Paragraph III(C) and is incorporated herein by reference.

RADIATION-GENERATION OF AMINES

A radiation-sensitive layer is provided, either combined and integral with the image-providing layer or as a separate layer positioned adjacent to the image-providing layer and separated therefrom by a layer that selectively passes $NH_3$ vapor but not other components of the element. The radiation-sensitive layer comprises a cobalt (III) complex, a binder, and optionally a photoactivator.

The complex can be any of those heretofore discussed. Because such complexes tend to be insensitive to radiation having wavelengths longer than about 300 nanometers, a photoactivator responsive to such longer wavelength radiation is preferred. As used herein, "photoactivator" means a spectral sensitizer or a photoreductant which renders the complex imagewise responsive. Thus, suitable photoactivators include spectral sensitizers such as those disclosed and claimed in commonly assigned U.S. application Ser. No. 461,171, filed Apr. 15, 1974, entitled "Spectral Sensitization of Transition Metal Complexes", by Albert T. Brault et al, now abandoned in favor of continuation-in-part application Ser. No. 629,931, filed on Nov. 7, 1975 and now abandoned. Particularly useful examples of spectral sensitizers for use in the practice of this invention are those having an anodic polarographic half-wave potential (also referred to as a ground state oxidation potential) which is less than 1 volt. It is further preferred that the spectral sensitizers be chosen so that the sum of the cathodic polarographic half-wave potential (also referred to as a ground state reduction potential) and the anodic polarographic half-wave potential is more negative than −0.50 volt.

As used herein, polarographic measurements are made in accordance with the following procedure. Cathodic polarographic half-wave values are obtained against an aqueous silver-silver chloride reference electrode for the electrochemical reduction of the test compound using controlled-potential polarographic techniques. A $1 \times 10^{-4}$ M methanol solution of the test compound is prepared. The solvent is 100 percent methanol, if the compound is soluble therein. In some instances, it is necessary to use mixtures of methanol and another solvent, e.g., water, acetone, dimethylformamide, etc., to prepare the $1 \times 10^{-4}$ M solution of the test compound. There is present in the test solution, as supporting electrolyte, 0.1 M lithium chloride. Only the most positive (least negative) half-wave potential value observed is considered, and it is designated herein as the ground state reduction potential or simply the reduction potential. Anodic half-wave values are determined against an aqueous silver-silver chloride reference electrode for the electrochemical oxidation of the tested compounds at a pyrolytic graphite electrode, and are obtained by controlled-potential voltammetry using solutions identical to those used to determine the cathodic polarographic values. Only the most negative (least positive) half-wave potential observed is utilized, and it is designated herein as the ground state oxidation potential. In both measurements, the reference electrode (aqueous silver-silver chloride) is maintained at 20° C. Signs are given according to the recommendation of IUPAC at the Stockholm Convention, 1953. The well known general principles of polarographic measurements are used. See Kolthoff and Ligane, "Polarography" second edition, Interscience Publishers, New York (1952). The principles of controlled-potential electrochemical instrumentation which allows precise measurements in solvents of low conductivity is described by Kelley, Jones and Fisher, *Anal. Chem.*, 31, 1475 (1959). The theory of potential sweep voltammetry such as that employed in obtaining the anodic determinations is described by Delahay, "New Instrumental Methods in Electrochemistry" Interscience Publishers, New York (1954) and Nicholson and Shain, *Anal. Chem.*, 36, 706 (1964). Information concerning the utility and characteristics of the pyrolytic graphite electrode is described by Chuang, Fried and Elving, *Anal. Chem.*, 36, (1964). It should be noted that the spectral sensitizers and inert cobalt (III) complexes operable in this invention include those which contain oxidizable ions, such as iodide. For example, many tested compounds which are iodide salts are useful herein. However, the polarographic measurements referred to above cannot be determined in the presence of oxidizable ions. Therefore, such compounds are converted, solely for purposes of making polarographic determinations, to anions such a chloride or p-toluene-sulfonate which do not interfere in making accurate polarographic measurements. Hence, compounds containing oxidizable ions are included within the scope of the useful compounds defined herein and in the claims.

The spectral sensitizers useful in the practice of this invention can be chosen from among those classes of spectral sensitizers known to sensitize negative silver halide emulsions. The spectral sensitizers can take the form of sensitizing dyes, such as acridines, anthrones, azo dyes, azomethanes, cyanines, merocyanines, styryl and styryl base dyes, polycyclic hydrocarbon dyes, ketone dyes, nitro dyes, oxonols (including hemioxonols), sulfur dyes, triphenylmethane dyes, xanthene dyes, etc.

Cyanine dyes have been found to be particularly advantageous. The term "cyanine dye", as used herein, is to be construed broadly as inclusive of simple cyanines, carbocyanines, dicarbocyanines, tricarbocyanines, rhodacyanines, etc. Cyanine dyes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and can be fused to carbocyclic or heterocyclic ring systems either unsubstituted or substituted with halogen, phenyl, alkyl, haloalkyl, cyano, or alkoxy groups. The cyanine dyes can be symmetrical or unsymmetrical and can contain alkyl, phenyl, enamine or heterocyclic substituents on the methine or polymethine chain. Cyanine dyes include complex (tri- or tetra-nuclear) cyanines.

Merocyanine dyes can be employed which are generally comparable to the cyanine dyes discussed above. The merocyanine dyes can contain the basic nuclei noted above as well as acid nuclei such as thiohydantoins, rhodanines, oxazolidenediones, thiazolidenediones, barbituric acids, thiazolineones, and malononitriles. These acid nuclei can be substituted with alkyl, alkylene, phenyl, carboxyalkyl, sulfoalkyl, hydroxyalkyl, alkoxyalkyl, alkylamino groups or heterocyclic nuclei.

As examples of other useful spectral sensitizers, conventional optical brighteners which otherwise satisfy the criteria of this invention can be employed to spectrally sensitize inert cobalt (III) complexes. These are particularly useful as they can be incorporated into the fibers of the support if the support is a paper sheet. Exemplary categories of known optical brighteners useful in sensitizing inert cobalt (III)-complexes include stilbenes, triazenes, naphthylene sulfonates, oxazoles and coumarins. Particularly preferred optical brighteners useful in the practice of this invention are bis-triazinyl-aminostilbenes, particularly bis-triazinylamino-stilbene disulfonates. Exemplary preferred sensitizers of this type are disclosed in U.S. Pats. No. 2,875,058; 3,012,971 and 3,052,242.

It has been observed that a further example of a useful spectral sensitizer for inert cobalt (III) complexes is hematoporphyrin. For example, hexa-ammine cobalt (III) can be selectively spectrally sensitized to the red portion of the visible spectrum employing hematoporphyrin as a spectral sensitizer.

Exemplary spectral sensitizers preferred for use in the practice of this invention are described and listed in *Research Disclosure*, Vol. 130, February 1975, Publication No. 13023, Paragraphs III(A) through (L), expressly incorporated herein by reference.

Also suitable as photoactivators are photoreductants. As employed herein, the term "photoreductant" designates a material capable of molecular photolysis or photo-induced rearrangement to generate a reducing agent, which forms a redox couple with the inert cobalt (III) complex. The reducing agent spontaneously or with the application of heat reduces the inert cobalt (III) complex. The classes of photoreductants pertinent in general include quinones, disulfides, diazoanthrones, and phenazinium salts. In addition, diazophenanthrones, carbazides, diazosulfonates, diazonium salts and aromatic azides are useful.

Disulfide photoreductants are preferably aromatic disulfides containing one or two aromatic groups attached to the sulfur atoms. The nonaromatic group can take a variety of forms but is preferably a hydrocarbon group, such as an alkyl group having from 1 to 20 (preferably 1 to 6) carbon atoms.

The quinones which are useful as photoreductants include ortho- and para-benzoquinones and ortho- and para-naphthoquinones, phenanthrenequinones and anthraquinones. The quinones may be unsubstituted or incorporate any substituent or combination of subsitituents that do not interfere with the conversion of the quinone to the corresponding reducing agent. A variety of such substituents is known to the art.

A preferred class of photoreductants is internal hydrogen source quinones, that is, quinones incorporating labile hydrogen atoms. These quinones are more easily photoreduced than quinones which do not incorporate labile hydrogen atoms. When internal hydrogen source quinones are employed with external hydrogen source compounds their ease of photoreduction can generally be further improved.

Particularly preferred internal hydrogen source quninones are 5,8-dihydro-1,4-naphthoquinones having at least one hydrogen atom in each of the 5 and 8 ring positions. Other preferred incorporated hydrogen source quinones are those which have a hydrogen atom bonded to a carbon atom to which is also bonded the oxygen atom of an oxy substituent or a nitrogen atom of an amine substituted with the further provision that the carbon to hydrogen bond is the third or fourth bond removed from at least one quinone carbonyl double bond.

These photoreductants are further discussed in *Research Disclosure*, Vol. 126, Oct. 1974, Publication No. 12617, Paragraphs II(A)-(B), of which Paragraph (B) has a specific listing of individual compounds to be used with a metal complex (MC). The entire discussion therein is expressely incorporated herein by reference. The binder for the radiation-sensitive layer can be any suitable conventional binder, such as gelatin, cellulose acetate butyrate, polyvinylpyrrolidone, and others described in *Product Licensing Index*, Vol. 92, December 1971, Publication 9232, Paragraph VIII. Such a binder can account for from 50 to 90% of the weight of that layer.

IMAGE FORMATION

As noted above, the image-providing layer is either positioned adjacent to an exposed, radiation-responsive layer of the type described, or is an integral part of the latter. In either embodiment, the layer includes not only the cobalt (III) complex described above but also a blocked dye precursor. The two preferred classes of such precursors are blocked leuco dyes containing initially a chromophore group as an integral portion thereof and those that do not have the color-forming moiety preattached but instead require a secondary reaction with a separate preincorporated compound such as a color coupler.

The blocked leuco dyes which are particularly useful in the image-providing layer have the formula

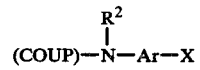

wherein COUP is a photographic color-forming coupler linked to said nitrogen atom through a carbon atom at the coupling position, such as, for example, a phenolic coupler, a pyrazolone coupler, a pyrazolotriazole coupler, couplers having open-chain active methylene groups and the like, and soluble couplers which have solubilizing groups attached thereto to provide a diffusible coupler, and the like; Ar is an aromatic group containing from about 6 to about 20 carbon atoms, including substituted and unsubstituted phenylene and naphthylene groups, and the like, and is preferably a phenylene group which is preferably substituted with halogen atoms or groups containing halogen atoms in the ortho and/or meta position of the ring, and X can be an amino group, including substituted amines, or preferably is a hydroxyl group or the radical —O—$R^1$, wherein $R^1$ is a carbonyl-containing group such as a group of the formula

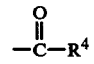

$R^4$ being a group containing 1 to 12 carbon atoms which can be an alkyl group or substituted equivalents thereof such as haloalkyl, alkoxy, aminoalkyl, and the like; or an aryl group or substituted equivalents thereof, such as haloaryl, alkylaryl, aryloxy, and the like; and $R^2$ is a hydrogen atom or the same substituent as $R_1$, provided that at least one of $R^1$ and $R^2$ is a carbonyl-containing group. In one highly preferred embodiment, $R^1$ and/or $R^2$ is trifluoroacetyl.

Preferably, $R^4$ is an alkyl group having 1-4 carbon atoms. The group defined as Ar above is preferably residue of an aromatic color developing agent such as an aminophenol, a phenylenediamine and the like and, of course, including the various substituents on the aromatic group which are known in the art for the respective color developing agent. In one preferred embodiment where Ar is the nucleus of an aminophenol developing agent, it can contain the same substituents as disclosed, for example, on the aminophenol developing agents disclosed in Bush et al. U.S. Pat. No. 3,791,827 issued Feb. 12, 1974. Further details on coupler definitions are found in U.S. Pat. No. 3,620,747 issued Nov. 16, 1971, and in the aforesaid Bush patent, both of which are incorporated herein by reference.

Table 1 sets forth typical, particularly useful examples of such blocked leuco dyes and the color formed when unblocked and when oxidized by the inert cobalt (III) complex. The blocking group has been encircled for ease in identification. It is this group which is removed in the presence of an amine such as ammonia, rendering the leuco dye oxidizable or conjugatable to the dye or color form.

Table 1
Representative Blocked Leuco Dyes
| No. | Structure | Color Formed |
|---|---|---|
| 1. | 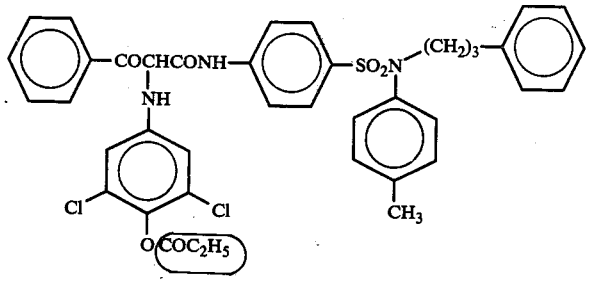 | (Yellow) |
| 2. | 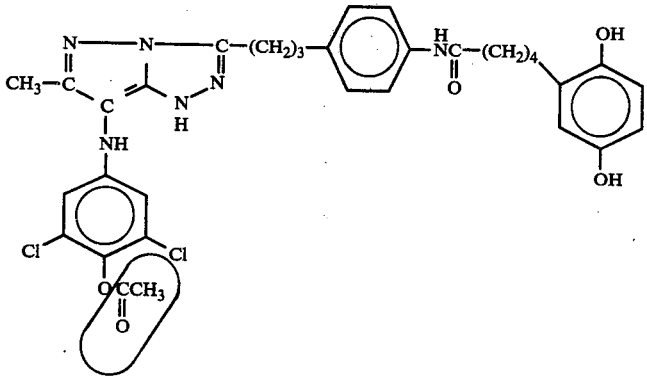 | (Magenta) |
| 3. | 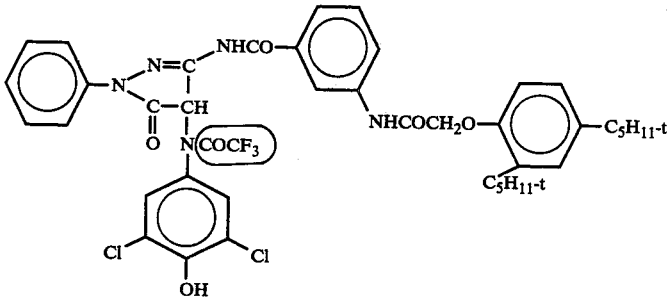 | (Magenta) |
| 4. | 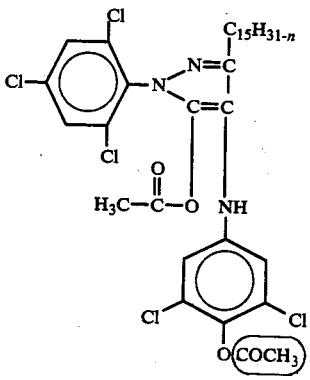 | (Magenta) |

Table 1-continued

Representative Blocked Leuco Dyes

| No. | Structure | Color Formed |
|---|---|---|
| 5. | 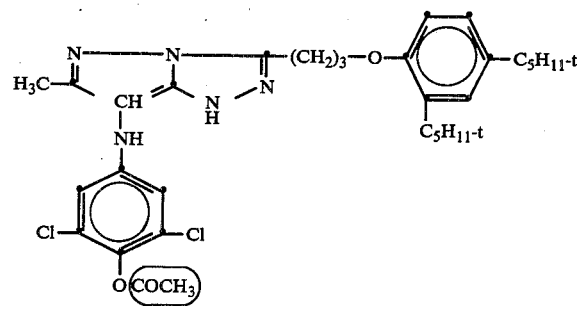 | (Magenta) |
| 6. | 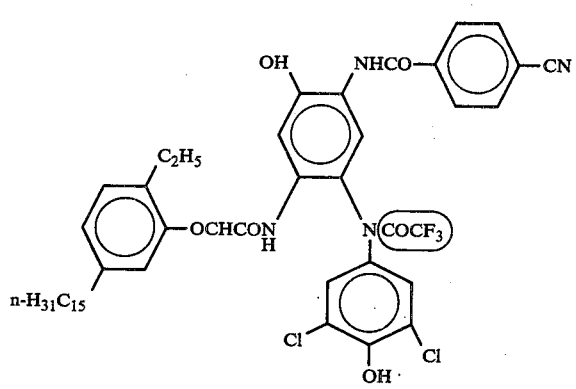 | (Cyan) |
| 7. | 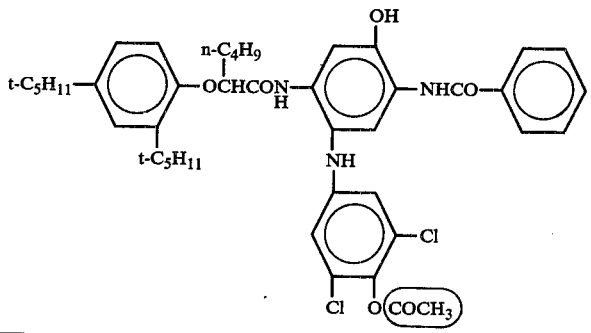 | (Cyan) |

The other class of preferred blocked dye procursors is a class of compounds which undergo a secondary reaction, when oxidized, with an additional compound preincorporated into the color-providing layer. A particularly useful class of such blocked dye precursors is color developing agents, the preincorporated compounds being in such instances color couplers. Any known color developing agent may be used, such as primary aromatic amines having the formula

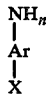

wherein Ar is as defined above for blocked leuco dyes; X is $R^{5'}NR^6$, —OH, or $N'HSO_2R^7$; $n$ is 2 or 3 if X is OH and is otherwise 3; and $R^5$, $R^6$ and $R^7$ are lower alkyl groups or alkylsulfonyl groups, such as sulfonamidoalkyl, preferably having from 1 to 10 carbon atoms. The blocking group in this class of blocked dye precursors is of course the extra proton attached to the nitrogen, when n is 3, or to the oxygen of X. In the presence of an amine such as ammonia, such blocked dye precursors deprotonate to an oxidizable form. In the presence of the reducible cobalt (III) complex and a color coupler, the reaction thus proceeds as follows (when X is $—NR^5R^6$):

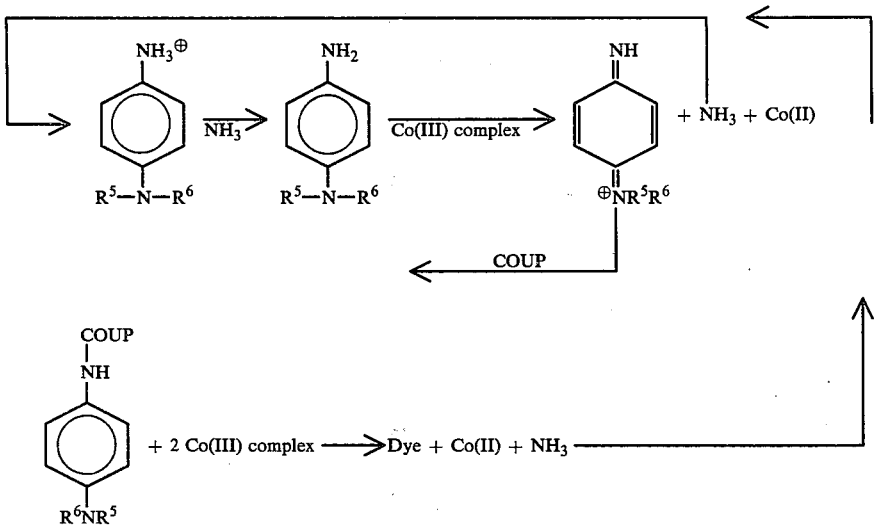

where COUP represents any suitable dye-forming coupler, giving an amplified reaction causing an increase in speed.

Primary aromatic amines particularly useful in the invention as described above include p-phenylene diamines, such as p-(N,N-dialkyl)amino anilines of the type disclosed in U.S. Pat. No. 2,304,953; and p-aminophenols, such as 2,6-dichloro-4-aminophenol.

The coupler which must be preincorporated in the image-providing layer along with the blocked dye precursor preferably is a dye-forming coupler capable of reacting with the oxidized color developing agent to ultimately form a dye image. The term "dye-forming coupler" includes any compound which reacts (or couples) with the oxidation products of a primary aromatic amine developing agent on photographic development to ultimately form an image dye in a hydrophilic colloid binder (e.g., gelatin) of the type useful for photographic silver halide. Typical preferred color couplers include cyan, magenta and yellow dye-forming couplers, such as are disclosed in U.S. Pat. Nos. 2,895,826; 2,875,057; 2,407,210; 3,260,506; 2,772,162; 2,895,826; 2,474,293; 2,369,489; 2,600,788; 2,908,073 and 3,519,429. Thus, representative couplers include phenols, naphthols, pyrazolones, $\beta$-diketones, $\beta$-ketoacylamides, and alkoxyanilides such as alkoxybenzoyl-acetanilides. Specific useful couplers include 5-[$\alpha$-(2,4-di-tert-amylphenoxy)-hexamido]-2-heptafluorobutyramidophenyl and 2,4-dichloro-5-p-toluenesulfonamido-1-naphthol, as well as those described in Graham et al U.S. Pat. No. 3,046,129, issued Jan. 24, 1962, column 15, line 45 through Column 18, line 51.

The binder for the image providing layer can be any one of those described above for the radiation-sensitive layer. Typically, it can account for up to 99% by weight of that layer. The surface or areal densities of the reactants can vary, depending upon the specific application. While the proportions of the non-binder reactants forming the image-providing layer can be varied widely, it is generally preferred for most efficient utilization for the reactants that they be present in roughly stoichiometric concentrations—that is, equivalent concentrations. One or more of these can, of course, be present in excess. Thus, it is useful to incorporate from 0.1 to 10 moles of the inert cobalt (III) complex per mole of the blocked dye precursor. With regard to the coupler, if used, the molar relationship is conventional and is controlled by its interaction with the oxidized dye precursor, which in turn is dictated by the type of final dye desired. Typical amounts of coupler include from about 0.1 moles per mole of blocked dye precursor to about 10 moles per mole of blocked dye precursor.

Typically, the image-providing layer can vary widely in thickness depending on the characteristics desired for the image-recording element—e.g., image density, flexibility, transparency, etc. For most photographic applications, coating thicknesses in the range of from 2 microns to 20 microns are preferred.

SEPARATION OF LAYERS

In those instances wherein the image-providing layer is separate from but adjacent to the radiation-sensitive layer, it is desirable to interpose an intermediate layer between them. Such layer preferably permits only selective passage of amine to the image-providing layer, and optionally can also permit ease of separation, i.e., stripping, after development is achieved. Therefore, such layers are preferably impermeable to liquid or compounds in the radiationsensitive layer that are capable of blanket reduction of the cobalt (III) complex in areas corresponding to unexposed regions of the radiation-responsive layer. For example, such blanket reductants can be present in the form of compounds incorporated into the radiation-sensitive layer which permit the catalysis of further reduction of the inert cobalt (III) complex, such as materials capable of forming at least a bidentate chelate with Co(II) initially formed by the image-wise exposure. Such materials are capable of diffusing or otherwise migrating to the image-providing layer in non-exposed areas to cause fog, unless the intermediate layer also serves as a barrier to such compounds. Thus, the polymer of this layer must be selectively permeable, that is, be relatively impermeable to a thermally transferrable material capable of forming a reducing agent for, or a catalyst for the reduction of, cobalt (III). Any polymer having such impermeability at least to the extent provided by cellulose acetate butyrate will suffice. Particularly useful examples of polymers meeting all three of the above requirements are poly(4,4'-isopropylidene diphenylene-1,3-trimethyl-3-phenylindane-4',5-dicarboxylate) (hereinafter "PIPA"); poly[4,4'-isopropylidene bis (2,6-dichlorophenylene) carbonate] (hereinafter TCBPA); polypropylene and particularly chlorinated polypropylene; and poly(styrene-co-maleimide).

Each of the radiation-sensitive layer and the image-providing layer can be provided with a support, or if the layers are combined into one, a support can be provided for the combined layer. Particularly such a support is desired where the binders are not self-supporting. The support can be any conventional photographic support, including transparent supports, such as film supports and glass supports, and opaque supports, such as metal and photographic paper supports. The support can be either rigid or flexible. The most common photographic supports for most applications are paper and film supports, such as cellulose acetate and poly(ethylene terephthalate) film supports. Suitable exemplary supports are disclosed in *Product Licensing Index,* Vol. 92, December 1971, Publication 9232, page 108. Photographic supports typically incorporate one or more subbing layers for the purpose of improving the adherency of the radiation-sensitive coating to the support.

COMBINED OPERATION OF THE FUNCTIONS

A further understanding of the preceding description will be obtained from a study of FIGS. 1–8, which illustrate the manner in which the image is formed as described. Thicknesses herein illustrated are exaggerated for clarity. The symbols are described in detail hereinafter and their meaning remains the same through all the figures.

In FIG. 1, element 20 is a radiation-sensitive element comprising a support 22; a radiation-sensitive layer 24 coated thereon comprising an inert cobalt (III) complex designated by circles, a photoactivator in an unexcited state designated by triangles, and preferably a binder; and a second layer 26 comprising a stripping layer or overcoat. FIG. 2 illustrates that imagewise exposure, designated by arrows 27 of portions 28 of element 20 through a mask 29, causes the photoactivator to be raised to an excited state, designated as solid triangles. Further development, such as by the optional supply of heat Q, causes, FIG. 3, the reduction of the inert cobalt (III) complex of layer 24 to form cobalt (II) ions and in portions 28 the release of the amine, designated by arrows 31, which diffuses through layer 26 as described below.

At this point, element 20 is either contacted with an imaging element 30, or such an element is preattached to element 20 as an integral portion thereof. In the latter instance, exposure can be through element 30 as it does not respond to light of wavelengths longer than about 300 nm.

Element 30 comprises preferably a support 32 and at least one image-providing layer 34 having uniformly distributed therein an inert cobalt (III) complex, again designated by circles, and a blocked dye precursor, designated by squares. As shown in FIG. 4, the amine which diffuses into portions 35 of layer 34 corresponding to the exposed portions of element 20 causes the unblocking of the dye precursor, designated by dashed squares. Thereafter, a redox reaction occurs, arrows 37 of FIG. 5, between the cobalt (III) complex and the unblocked dye precursor, generating in portion 35 a dye, shown as solid squares, cobalt (II) ions, designated as solid circles, and more amine. The amine, designated by arrows 38, FIGS. 5 and 6, transfers to adjacent blocked dye precursor molecules in portions 35 wherein more unblocking occurs. As shown in FIGS. 7 and 8, in portions 35 the newly unblocked dye precursor then proceeds to reduce adjacent inert cobalt (III) complex, shown by electron exchange 37 whereby the precursor is oxidized to the dye from (black squares) and still more amine is produced, arrow 38. Eventually, element 20 may be stripped from element 30, FIG. 8. Overdevelopment is prevented by controlling the temperature of the developing element so that fogging by lateral diffusion is avoided.

Such imaging elements as described above with respect to FIGS. 1–8 have been found to be particularly useful where higher speeds are required. When a radiation-sensitive element as described above for element 20 is prepared, exposed to a step tablet, and then developed either with a receiver sheet such as element 30 described above or a Recordak Type H Diazo Sheet as a control receiver sheet, the result is as appears in FIG. 9. The dashed curve represents the results for the unamplified diazo sheet used as the control, while the solid line is the result achieved by the amplification provided by the blocked leuco dye. Measured at a density of 1.0 above fog, the invention provides a 1.4 log E increase in speed against that achieved by the diazo receiver.

FIG. 10 illustrates a similar embodiment, except the image-providing layer has been combined, i.e., intermixed, with the radiation-sensitive layer. Parts similar to those previously described bear the same reference numerals to which the distinguishing suffix "*a*" has been added. Thus, element 40 comprises a support **22*a* and a single active layer 42, which includes the cobalt (III) complex (circles), the photoactivator (triangles) and the blocked dye precursor (squares). The reaction proceeds exactly as previously described upon imagewise exposure, except that no transfer of amine to an adjacent layer is necessary. However, an overcoat 44** which is relatively impermeable to amine can be used to prevent premature escape of the amine used to unblock the dye precursor. Typical materials suited for such use include polymeric anhydrides such as poly(octadecyl vinyl ether maleic anhydride).

OTHER ALTERNATE EMBODIMENTS

As disclosed in the aforesaid application by DoMinh, when compounds capable of forming at least bidentate chelates with cobalt (II) are included in the radiation-sensitive element, the result is an amplification of the decomposition of the cobalt (II) complex due to such chelates themselves further catalyzing the reduction of the complex. That is, the chelates form as the Co(II) is formed. Any compound containing a conjugated $\pi$-bonding system capable of forming at least a bidentate chelate and preferably a tridentate chelate with cobalt (III) can be employed, excluding however those with anions having pKa values sufficient to deprotonate cobalt (II) chelates. As is well appreciated by those skilled in the art, conjugated $\pi$-bonding systems can readily be formed by combinations of atoms such as carbon, nitrogen, oxygen and/or sulfur atoms and typically include double bond providing groups, such as vinyl azo, azinyl, imino, formimidoyl, carbonyl and/or thiocarbonyl groups, in an arrangement that places the double bonds in a conjugated relationship. A variety of compounds are known to the art including a conjugated $\pi$-bonding system capable of forming at least bidentate chelates. Particularly preferred chelating compounds include nitroso-arols, dithiooxamides, formazan, aromatic azo compounds, hydrazones and Schiff bases.

A complete discussion of such compounds and a representative listing will be found in *Research Disclosure*, Vol. 135, July 1975, Publication 13505, especially in Paragraph III. That portion of said Vol. 135 of *Research Disclosure* is expressly incorporated herein by reference.

Figure 11:
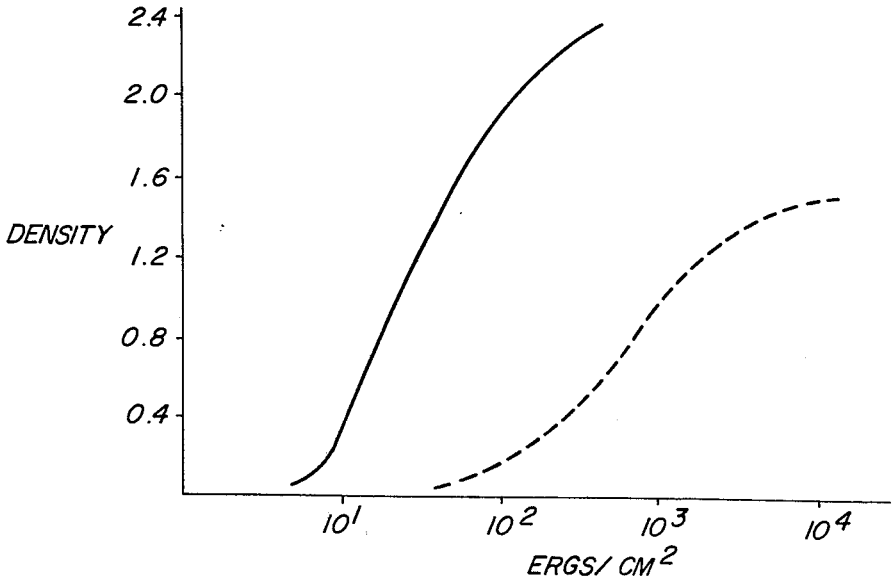
FIG. 11 is a curve plot similar to that of FIG. 9, illustrating an increased speed for an alternate embodiment.

Thus, the inclusion of such chelate-forming compounds will cause amplification via the Co(III) ions, while the blocked dye precursor forms amplification via the amine formed. The result is an increase in speed over that achieved by either one of the amplifiers when used alone. This maximum in speed increase will occur regardless where the chelate forming compound is located, that is, whether it is in the radiation-sensitive element or is in the color-forming layer, or both. FIG. 11 is illustrative of the reduction in necessary exposure and thus the speed increase achieved by a radiationsensitive element 20 having 1-(2-pyridylazo)-2-naphthol as the added chelate-forming compound when it is exposed and developed either in contact with an imaging element 30 as described above, or with a Recordak Type H Diazo Sheet as the control. The dashed line represents the results of the control. At a density of 1.0 above gross fog, the combination of chelate-forming compounds and blocked dye precursors, represented by the solid line, resulted in a decrease in required exposure of a factor of almost $10^2$. Similar results occur when that which is exposed is a combined element in which the chelateforming compound is mixed in with the blocked dye precursor.

Although the above discussion is directed to an element adapted to provide a monochromatic image, it will be understood that the invention can also be utilized in a multicolored element. This can be readily achieved by the provision of three separate but adjacent image-forming layers, each of which has dispersed in it a blocked dye precursor in accordance with the invention which is sensitized to the appropriate additive primaries. Thus, it is contemplated that the uppermost layer would be sensitized to green, as by the use of 3-carboxy-methyl-5-[(3-ethyl-2-benzothiazolinylidene)ethylidene]rhodanine, and a magenta-dye forming coupler such as 1-(2,4,6-trichlorophenyl)-3-{5-[α-(3-tert-butyl-4-hydroxyphenoxy)tetradecanamido]-2-chloroanilino}-5-pyrazolone would be included. The next layer under the uppermost layer would be sensitized to red, as by the use of hematoporphyrin, and a cyan-dye forming coupler such as a phenol would be incorporated therein. The lowermost layer adjacent to the support would be sensitized to blue, such as by the incorporation of 4[(3-ethyl-2-benzothiazolinylidene)-iso-propylidene]-3-methyl-1-(p-sulfophenyl)-2-pyrazoline-5-one; and a yellow-dye forming coupler such as α-pivalyl-4-(benzyloxyphenyl-sulfonyl)phenoxy-2-chloro-5-[α-(2,4-di-tert-amylphenoxy)butyramido]-acetanilide would be dispersed in this layer. Suitable barrier layers interposed between the layers would be utilized to prevent unwanted diffusion of exposure reaction products to the wrong color layer prior to development.

For both the imaging element and the radiation sensitive element in all of the above described embodiments, the supported layers can be formed using any conventional coating technique. Typically, the reactants, the binder and any desired addenda are dissolved in a solvent system and coated onto the support by such means as whirler coating, brushing, doctor blade coating, hopper coating and the like. Thereafter the solvent is evaporated. Other exemplary coating procedures are set forth in the *Product Licensing Index* publication cited above at page 109. Coating aids can be incorporated into the coating composition to facilitate coating as disclosed on page 108 of the *Product Licensing Index* publication. It is also possible to incorporate antistatic layers and/or matting agents as disclosed on this page of the *Product Licensing Index* publication.

The solvent system can be a common solvent or a combination of miscible solvents which together bring all of the reactants into solution. Typical preferred solvents which can be used alone or in combination are water; lower alkanols, such as methanol, ethanol, isopropanol, t-butanol and the like, or other organic solvents particularly suited for the blocked dye precursor being used; and dibutyl phthalate or other solvents particularly useful with the coupler being used.

EXAMPLES

Following are examples, intended to be illustrative only, of the invention described above.

EXAMPLE 1

A first, radiation-sensitive element such as element 20 was prepared by coating onto a polyester film support a layer of 150 mg/ft$^2$ polyvinylpyrrolidone, 100 mg/ft$^2$ $[Co(NH_3)_6]$ $(CF_3COO)_3$, and 65 mg/ft$^2$ of 2-(2-hydroxyethyl)-1,4-naphtho-quinone, and an overcoat of 300 mg/ft$^2$ of PIPA. A second, imaging element such as element 30 was prepared by coating a polyester film support with a layer of 500 mg/ft$^2$ cellulose acetate butyrate, 100 mg/ft$^2$ $[Co(NH_3)_6]$ $(CF_3COO)_3$, and 100 mg/ft$^2$ of blocked leuco dye no. 2, Table 1.

The first element was exposed in an IBM Microprinter and then placed so that the PIPA overcoat contacted the color-providing layer of the second element to form a sandwich which was passed twice at a speed of 0.35 cm/sec through rollers at a temperature of 120° C. After separation of the element, a good dye image was observed in the second element.

EXAMPLE 2

A single integral element was prepared by coating over a polyester film support a layer of 150 mg/ft$^2$ of polyvinylpyrrolidone, 16 mg/ft$^2$ of 2-(N-ethyl-N-benzylamino)-3-chloro-1,4-naphthoquinone, 60 mg/ft$^2$ of $[Co(NH_3)_6]$ $(CF_3COO)_3$ and 30 mg/ft$^2$ of the blocked leuco dye of Example 1. An overcoat of PIPA was formed as in Example 1. Exposure was achieved in the IBM Microprinter, followed by heat processing at 100° C. for 5–10 seconds. A good dye image was formed.

EXAMPLE 3

Three coating solutions were prepared, each containing the following components

| | | |
|---|---|---|
| coupler | 0.60 | mmole |
| N-ethyl-N-(2-methoxyethyl)-phenylenediamine ditosylate | 0.330 | g |
| hexa-ammine cobalt(III) trifluorocetate | 0.600 | g |
| poly(4-vinylpyrrolidinone) | 3.0 | g |
| 2-methoxyethanol | 27.0 | g |

The cyan, magenta, and yellow couplers were 1-hydroxy-2-naphthopiperidide, 3-methyl-1-phenyl-2-pyrazolin-5-one, and o-acetoacetanisidide, respectively. The solutions were coated with a 0.1 mm coating knife at 55° C. on separate samples of a poly(ethylene terephthalate) film support containing a vinylidene chloride-acrylonitrile-acrylic acid subbing layer and dried. These layers were then overcoated with a protective layer of 10% Lucite 2041 [poly(methyl methacrylate)] in toluene with a 0.05 mm coating knife. Each of the three coatings were contacted with sections of an exposed radiation-sensitive element of the type described in Example 1 and were developed through hot rollers at 115° C. at a rate of 2.3 cm/sec. Cyan, magenta, and yellow images on clear backgrounds were produced.

EXAMPLE 4

A solution was prepared by dissolving 32 mg of the blocked leuco dye of Example 1, 32 mg tris(1,3-propanediamine) cobalt (III) trifluoroacetate, 8 mg 2,2'-bipyridine, and 43 mg 2-isopropoxy,1,4-naphthoquinone in 1 gm of 2-methoxy ethanol containing 1 drop of 10% trifluoroacetic acid in water. To this solution 2 g of a 15% solution of poly(N-vinyl pyrrolidone) in methanol were added. This dope was coated with a 0.1 mm doctor blade on subbed poly(ethylene terephthalate) support. An overcoat of 10% TCBPA in 2:1 by weight of toluene to dichloroethane was applied with a 0.05 mm doctor blade.

The resulting film was exposed for ½ second through a silver master to a 400 watt medium pressure mercury arc lamp (commercially available as a Micro Master Diazo Copier). The exposed film was heated for 40 seconds on a 140° C. hot block to produce an image with a green density of 2.2 and a background with green density =0.04.

The invention has been described in detail with reference to certain preferred embodiments thereof but it will be understood that variations and modifications can be effected within the spirit and scope of the invention.

What is claimed is:

1. An imaging element comprising at least one image-providing layer, said layer including (a) an inert cobalt (III) complex containing amine ligands, said complex being reducible to a form which releases the ligands, and (b) a blocked dye precursor which is amine activatable to form an unblocked dye precursor capable of an oxidation-reduction reaction with said complex to form a dye, said dye precursor being a blocked leuco dye having the formula $$(\text{COUP})-\overset{\overset{\displaystyle R^2}{|}}{N}-\text{Ar}-X$$

wherein COUP is a photographic color-forming coupler connected to the nitrogen atom through a carbon atom at the coupling position; Ar is a substituted or unsubstituted para-phenylene group containing from 6 to about 20 carbon atoms, the substituents of which are halogen atoms in the ortho or meta position of the ring; and X is either an amino group, a hydroxyl group, or the group:

$$-O-R^1$$

wherein $R^1$ is a hydrolyzable carbonyl-containing group of the formula $$-\overset{\overset{\displaystyle O}{\|}}{C}-R^4$$

wherein $R^4$ is a group containing 1 to 12 carbon atoms and is an alkyl group or an aryl group; and $R^2$ is a hydrogen atom or the same substituent as $R^1$, provided that at least one of X and $R^2$ is a carbonyl-containing group.

2. An element as defined in claim 1 wherein said element is substantially free of a photoactivator, whereby the element is substantially insensitive to visible light.

3. An element as defined in claim 1 and further including a radiation-sensitive layer adjacent to said image-providing layer, said radiation-sensitive layer including (a) an inert cobalt (III) complex containing amine ligands, and complex being reducible to a form which releases the ligands, and (b) a photoactivator responsive to radiation within at least the visible spectrum, said photoactivator being either a spectral sensitizer or a photo-reductant.

4. An element as defined in claim 3 wherein said photoreductant is a quinone.

5. An element as defined in claim 3 wherein said radiation-sensitive layer is removably associated with said image-providing layer.

6. An element as defined in claim 3 and further including a third layer positioned between said image-providing layer and said radiation-sensitive layer, said third layer comprising a gas-permeable polymer.

7. An element as defined in claim 1 and further including in said layer a photoactivator which is either a spectral sensitizer or a photoreductant.

8. An element as defined in claim 1 and further including in said layer a compound containing a conjugated $\pi$-bonding system capable of forming at least a bidentate chelate with cobalt (III), said layer excluding acid anions having pKa values sufficient to deprotonate cobalt (II) chelates.

9. An element as defined in claim 1 wherein said complex contains amine ligands.

10. An element as defined in claim 9 wherein said complex is hexa-ammine cobalt (III) trifluoroacetate.

11. An element as defined in claim 1 wherein said complex is tris(1,3-propanediamine) cobalt (III) trifluoroacetate.

12. An imaging element comprising at least one image-providing layer, said layer including (a) an inert cobalt (III) complex containing amine ligands, said complex being reducible to a form which releases the ligands, and (b) a blocked dye precursor which is amine activatable to form an unblocked dye precursor capable of an oxidation-reduction reaction with said complex to form a dye, said blocked dye precursor having the formula $$\overset{\oplus}{N}H_3-\text{Ar}-X$$

wherein Ar is a substituted or unsubstituted para-phenylene group containing from 6 to about 20 carbon atoms, the substituents of which are halogen atoms in the ortho or metaposition of the ring;

X is $R^{5'}NR^6$, or $N'HSO_2R^7$;

and $R^5$, $R^6$, and $R^7$ are alkyl or alkylsulfonyl having from 1 to 10 carbon atoms in the alkyl portion.

* * * * *

UNITED STATES PATENT AND TRADEMARK OFFICE

CERTIFICATE OF CORRECTION

PATENT NO. : 4,124,392

DATED : November 7, 1978

INVENTOR(S) : Anthony Adin, Thomas J. Huttemann and Robert D. Lindholm

It is certified that error appears in the above-identified patent and that said Letters Patent are hereby corrected as shown below:

Column 20, line 65 (claim 12), "X is $R^{5'}NR^{6}$, or $N'HSO_2R_7$" should read -- X is $R^{5'}NR^{6}$, or $\overset{'}{N}HSO_2R^{7}$ --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*